US007259682B2

(12) United States Patent
Vannerus et al.

(10) Patent No.: US 7,259,682 B2
(45) Date of Patent: Aug. 21, 2007

(54) CHILD DISTANCE AND WATER IMMERSION ALARM

(75) Inventors: Jerker Vannerus, Bromma (SE); Daniel Hallqvist, Bromma (SE)

(73) Assignee: Safemind AB, Bromma (SE)

( * ) Notice: Subject to any disclaimer, the term of this patent is extended or adjusted under 35 U.S.C. 154(b) by 194 days.

(21) Appl. No.: 10/545,318

(22) PCT Filed: Feb. 13, 2004

(86) PCT No.: PCT/SE2004/000190

§ 371 (c)(1),
(2), (4) Date: Aug. 12, 2005

(87) PCT Pub. No.: WO2004/072922

PCT Pub. Date: Aug. 26, 2004

(65) Prior Publication Data

US 2006/0202839 A1 Sep. 14, 2006

(30) Foreign Application Priority Data

Feb. 13, 2003 (SE) ..... 0300386

(51) Int. Cl.
*G08B 23/00* (2006.01)

(52) U.S. Cl. ..... 340/573.6; 340/539.11; 340/539.13; 340/539.18; 340/539.21

(58) Field of Classification Search ..... 340/573.6, 340/573.4, 539.1–539.21
See application file for complete search history.

(56) References Cited

U.S. PATENT DOCUMENTS 5,049,859 A * 9/1991 Arnell ..... 340/573.6

(Continued)

FOREIGN PATENT DOCUMENTS

FR 2 806 508 9/2001

(Continued)

OTHER PUBLICATIONS

International Search Report fo PCT/SE2004/000190, mailed May 11, 2004.

*Primary Examiner*—Jeffery Hofsass
*Assistant Examiner*—Anne V. Lai
(74) *Attorney, Agent, or Firm*—Nixon & Vanderhye P.C.

(57) ABSTRACT

The invention concerns a system and a method of monitoring live beings, which combines zone and water alarms, including an alarm unit to be arranged on a being's body and a portable alarm centre handled by a person that monitors the being, wherein the alarm unit includes a sender for continuous wireless transfer of intermittent signals on a first channel and transfer of an arbitrary type of signal on a second channel, and wherein the alarm centre receives signals sent from both channels for status monitoring of the alarm unit. Activation of an alarm is achieved in the alarm centre when the intermittent signal differs from a predetermined intermittent signal state. The arbitrary type of signal is sent on the second channel or channel 2 when a water sensor, included in the alarm unit, detects contact with a predetermined quantity of water. Signaling on the first channel is turned off by a switch in the alarm unit when the arbitrary type of signal is sent to the alarm center. A normal state for monitoring is within a distance zone from the alarm center when the intermittent signal is in the mentioned predetermined signal state, and the risk of a drowning accident exists when the arbitrary type of signal is emitted on the second channel, wherein a drowning accident alarm is activated in the alarm center, and wherein the switch turns off the intermittent signal. This means that the system has raised the alarm twice for a drowning accident through the prevailing signal states on both channels. A third drowning accident alarm is achieved in that the signal on the second channel does not reach the alarm center when the alarm unit is located at a sufficiently great depth of water.

55 Claims, 4 Drawing Sheets

U.S. PATENT DOCUMENTS

| | | | | | |
|---|---|---|---|---|---|
| 5,144,285 | A * | 9/1992 | Gore | 340/573.6 |
| 5,461,365 | A | 10/1995 | Schlager et al. | 340/573.4 |
| 5,486,814 | A * | 1/1996 | Quinones | 340/573.6 |
| 5,886,635 | A * | 3/1999 | Landa et al. | 340/573.6 |
| 5,963,130 | A * | 10/1999 | Schlager et al. | 340/573.6 |
| 6,154,140 | A * | 11/2000 | Thorpe et al. | 340/573.6 |
| 6,486,777 | B2 * | 11/2002 | Clark | 340/539.1 |
| 6,567,004 | B1 * | 5/2003 | Landa et al. | 340/573.1 |

FOREIGN PATENT DOCUMENTS

| | | | |
|---|---|---|---|
| GB | 2 343 776 | A | 5/2000 |
| GB | 2 376 784 | A | 12/2002 |
| GB | 2 382 909 | A | 6/2003 |
| WO | 87/06748 | | 11/1987 |

* cited by examiner

CHILD DISTANCE AND WATER IMMERSION ALARM

This application is the US national phase of international application PCT/SE2004/000190, filed 13 Feb. 2004, which designated the U.S. and claims priority of SE 0300386-0, filed 13 Feb. 2003, the entire contents of each of which are hereby incorporated by reference.

TECHNICAL FIELD

The present invention concerns a system and method for monitoring humans and animals that combines a zone alarm and a water alarm.

TECHNICAL STATE OF THE ART

For small children, people with functional handicaps and also for domestic animals, depending on a combination of unforeseen events and the environment dangers can arise as a consequence of negligence and/or lack of knowledge on the part of both the individual concerned (child, handicapped person or animal) and its possible protector (parent, supervisor). For example, it is difficult for a small child to realise the danger in exposing himself/herself to deep water, fire or a road with much traffic since situations where these factors are included often include unknown risk factors for them and the same can be said concerning people with certain degrees of mental sickness.

When it comes to small children that can crawl and/or walk it is rather so that everything new is exciting and must be investigated, which of course is a primary condition for learning, but which also causes a great deal of worry by parents that must have additional extra careful monitoring of these little ones. Despite parents generally being careful to monitor and protect their children, every day accidents happen where small children hurt themselves seriously or fatally as a consequence of their having put themselves in dangerous situations when parents or other responsible person's attention has temporarily been lacking.

A device for water alarming intended for children is previously known through the American patent U.S. Pat. No. 5,486,814, which describes a device that gives an alarm on contact with water and that is intended to be fastened to the child to be protected. The device according to the US document is thus equipped with a sending unit with a water sensor for continuous radio signalling to a receiver unit, whereby breaking off the signal to the receiver unit activates an alarm in the receiver unit. The signal interruption is caused by for instance the water sensor's contacting water and in the case of power failure in the sender unit, for instance because of battery failure.

Through U.S. Pat. No. 5,289,163 a monitoring and localisation device for children is previously known with which a child's position is monitored through detecting changes in the signal strength of a sent radio signal. The child has a radio signal transmitter that sends a radio signal to a receiver device carried by an adult. In case the radio signal is too weak this means that the child is too far away from the adult person that carries the signal receiving device. Alarming is achieved thereby for weak radio signals and realised in devices through a sound signal or alternately by vibration.

Disadvantages of the above mentioned technical state of the art include, among others, that there is no solution that coordinates a distance and a water alarm in one and the same device. A person that wants to ensure that a child is sufficiently monitored is forced to use and check two different alarm systems. Furthermore, a constantly sent radio signal, according to the technical state of the art above, is sensitive and can often cause alarms for the wrong reasons by affecting the signal strength temporarily because of something other than the danger the alarm concerns. For instance incorrect raising of the alarm can be caused by alternative weakening or interruption of a continuous signal in the solutions according to U.S. Pat. No. 5,289,163 and U.S. Pat. No. 5,486,814, by factors such as battery failure, physical obstacles that block the signal, radio shadows, electrical failures or other functional disturbances in either the sender or the receiver devices. Thereby in practice it is hard to determine how urgent it really is when an alarm is activated since none of the solutions according to the US documents makes it possible to determine if it is a case of a true alarm, such as an exceeded distance or contact with water, or a so-called false alarm for other reasons. For a water alarm the time factor is always of extreme importance and it is therefore necessary to always be able to distinguish an alarm caused by contact with water from other causes for alarm with certainty. Additionally it is important that the alarm function significance not diminish and that an activated alarm is not ignored after a time because of a number of earlier "false" alarms, according to the example in the "Peter and the wolf" fairy-tale.

Another solution for giving the alarm on contact with water is presented in U.S. Pat. No. 6,157,303, which describes a water alarm, preferably for children, where a portable sender unit has a water sensor on a circuit board, which detects a change in capacitance in order to emit an alarm signal via a base station on contact with water. Conductors are arranged on each side of the circuit board with which the sensor can register different capacitance levels so that "false" water alarms for instance because of casual contact with water can be distinguished from "real" water alarms. This solution for a water alarm is limited because an alarm can only be realised when the signal from the sender unit reaches the base station. In cases where the sender signal is blocked by objects or hindered in other ways no alarm is raised and in the worst case the child cannot be saved because of this. For instance a concrete quay, boat, or other stationary or temporary object in or near water could keep the signal from reaching the base station.

There is a need for a device for monitoring live beings, such as people and animals, that can be adjusted in order to emit alarms already before contact with water happens and that is more dependable in regard to an alarm's indeed being activated in the event of contact with a water-surface and where these two causes for alarm, i.e. exceeded distances and contact with water, are distinguishable by a supervisor.

SUMMARY OF THE INVENTION

The present invention aims at showing a system and a method that combines a water alarm and a zone alarm where the alarm signal is specific depending on the cause of the alarm and includes a double alarm on contact with a water surface.

In this respect the present invention concerns a system for monitoring live beings, which combines a zone alarm and a water alarm including an alarm unit to be arranged on a being's body and a portable alarm centre to be handled by a person that monitors the being, which alarm unit includes a sender for continuous wireless transfer of intermittent signals on a first channel and transfer of an arbitrary type of signal on a second channel, and which alarm centre receives signals sent on both channels for status monitoring of the alarm unit. The system includes an alarm means in the alarm centre that triggers alarms if the intermittent signal differs from a predetermined intermittent signal state. It further includes a water sensor in the alarm unit that on contact with a predetermined quantity of water triggers the alarm unit to send the arbitrary type of signal on the second channel and a switch that cuts off signalling on the first channel. There is a normal state for monitoring within a distance zone from the alarm centre when the intermittent signal is within the said predetermined signal state and there is the risk of a drowning accident when any type of signal is sent on the second channel, wherein a drowning accident alarm is activated in the alarm centre, and wherein the switch turns off the intermittent signal, which entails that the system raises the alarm twice for a drowning accident through the prevailing signal state in both channels. A third drowning accident alarm is achieved by the signal on the second channel not reaching the alarm centre when the alarm unit is at a sufficiently great depth of water.

In one embodiment of the system according to the present invention a signal state is determined by the intermittent signal's strength and periodicity at reception in the alarm centre.

Another embodiment of the system according to the present invention shows that the arbitrary signal is a continuous or intermittent signal.

In yet another embodiment of the system according to the present invention the second channel consists of time gaps between the intermittent signals in the first channel.

An additional embodiment of the system according to the present invention shows that the channels consist of respective frequencies on a radio carrier wave.

In an additional embodiment of the system according to the present invention there is a threshold value switch arranged in the alarm centre for adjusting the limits of the intermittent signal's strength and periodicity within which the normal state exists.

In an additional embodiment of the system according to the present invention it is shown that the periodicity of transmission of the intermittent signals is adjustable with an adjustment device coupled to the sender in the alarm unit.

Another embodiment of the system according to the present invention shows that the alarm device in the alarm centre is arranged to activate an alarm in case either the strength or the periodicity of the intermittent signal falls outside its pre-adjusted limits.

In yet another embodiment of the system according to the present invention the alarm is arranged to be activated in case the signal falls outside pre-adjusted limits a predetermined number of times one after the other by a predetermined margin exceeding at least one of the time and the periodicity.

Another embodiment of the system according to the present invention shows that the alarm unit includes means for giving off acoustic alarms whereby an acoustic alarm is activated in the alarm unit when the water sensor triggers the signal on the second channel to the alarm centre.

In yet another embodiment of the system according to the present invention the water sensor includes a first and a second disk of electrically conducting material and wherein the disks are arranged nearby each other, wherein the first disc is attached to a power source in the alarm unit and wherein the second disc carries a voltage via the first disc and the water gap formed between the disks on contact with water, in order to trigger the signal on the second channel.

Other embodiments of the system according to the present invention show that the water sensor includes a pressure sensor that, at a pre-adjustable water pressure, triggers the signal on the second channel or that the water sensor includes an optical sensor or another indicator for water detection.

In yet another embodiment of the system according to the present invention there is a threshold value switch arranged adjustably for a zone alarm at a strength of the received intermittent signal that does not reach an adjusted limit value.

Yet another embodiment of the system according to the present invention shows that the threshold value switch is arranged adjustably for a zone alarm at a strength of the received intermittent signal that exceeds an adjusted limit value.

Yet another embodiment of the system according to the present invention shows that the threshold value switch is arranged adjustably for a zone alarm at a strength of the received intermittent signal that does not reach an adjusted first limit value and exceeds an adjusted second limit value.

In an additional embodiment of the system according to the present invention the alarm unit includes an attachment device with a lock device for securely attaching the unit to beings.

In yet an additional embodiment of the system according to the present invention the attachment device includes manipulation protection that activates the arbitrary signal on manipulation of the lock mechanism.

Yet another embodiment of the system according to the present invention shows that the attachment device includes manipulation protection that turns off the intermittent signal on manipulation of the lock mechanism.

Additional other embodiments of the system according to the present invention show that the alarm centre includes at least one of a loudspeaker for acoustic alarms and a display for visual alarms.

In yet another embodiment of the system according to the present invention the alarm unit includes an adjustment device for adjusting both the intermittent and the arbitrary signal's radio frequencies.

In yet another embodiment of the system according to the present invention the alarm centre is arranged to receive signals with separate radio frequencies.

In yet another embodiment of the system according to the present invention the alarm device in the alarm centre is arranged to activate distinguishable visual and/or acoustic alarms depending on the signal's radio frequency so that several sender units can be coupled to one and the same alarm centre for signal frequency adjusted specific zone and water alarms for each connected alarm unit.

Yet another embodiment of the system according to the present invention shows that each signal to the alarm centre includes a connection to an ID string that identifies which alarm unit broadcasts the signal.

An additional embodiment of the system according to the present invention shows that the unique ID string is associated with a person's name in the alarm centre for an individually chosen alarm that can be either acoustically or visually activatable on a display in the centre.

Another embodiment of the system according to the present invention shows that a position determination by the alarm unit is achieved with a positioning device included in the alarm unit or the alarm centre, such as a GPS receiver or similar positioning device, whereby the position coordinates of the alarm unit are transmitted to the alarm centre.

Furthermore, the present invention shows a method for monitoring live beings, which combines zone alarms and water alarms, including an alarm unit arranged on a being's body and a portable alarm centre handled by a person that monitors the being, wherein the alarm unit includes a sender for continuous wireless transfer of intermittent signals on a first channel and transmission of an arbitrary type of signal on another channel, and wherein the alarm centre receives signals sent from both channels for status monitoring of the alarm unit. The procedure includes the procedure steps:

activation of an alarm in the alarm centre when the intermittent signal differs from a predetermined intermittent signal state;

sending the arbitrary type of signal on the second channel when a water sensor included in the alarm unit detects contact with a predetermined quantity of water;

cancelling the signal on the first channel with a switch in the alarm unit when the arbitrary type of signal is sent to the alarm centre; and wherein there is a normal state for monitoring within a distance zone from the alarm centre when the intermittent signal is within the said predetermined signal state, and wherein there is the risk of a drowning accident when the arbitrary type of signal is emitted on the second channel, wherein a drowning accident alarm is activated in the alarm centre, and wherein the switch turns off the intermittent signal, which means that the system has raised the alarm for a drowning accident twice by the signal state prevailing on both channels, and a third drowning accident alarm is achieved in that the signal on the second channel does not reach the alarm centre when the alarm unit is at a sufficiently great depth of water.

The attached dependent method claims concern embodiments of the present invention in compliance with the above described embodiments of the system.

BRIEF DESCRIPTION OF THE DRAWINGS

In the following description reference is made to the attached figures for a better understanding of the invention and its embodiments, where.

DETAILED DESCRIPTION OF PREFERRED EMBODIMENTS

Figure 1:
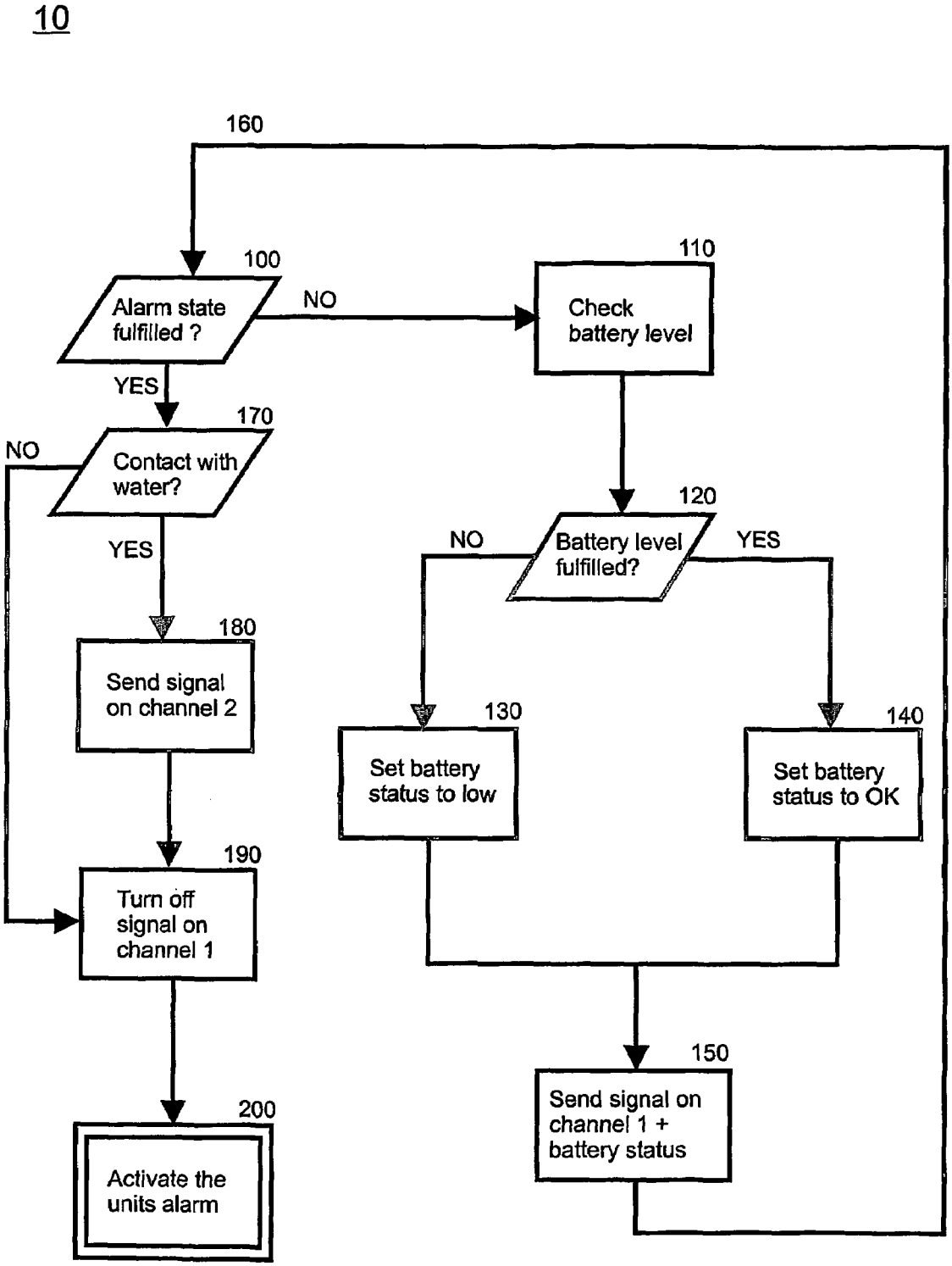
FIG. 1, an alarm unit 10 intended to be attached to a being to be monitored is illustrated with a flow chart, according to an embodiment of the present invention.

Below follows a detailed description of a system and preferred embodiments of a method of monitoring live beings, such as people and animals, that combines distance monitoring and water monitoring according to the present invention, wherein reference is made to the attached drawings.

Through raising the alarm twice for contact with water and through a distinguishability depending on the cause of the alarm the present invention provides more complete and dependable monitoring of beings including improved protection against dangers.

On contact with water the risk of drowning is often imminent for small children, among others, and it is therefore especially important that the alarm activate quickly, dependably and at each occurrence of contact with a water surface. With the system and method according to the present invention raising the alarm twice on separate channels on contact with water is achieved. In part the alarm is given by a signal then being activated and sent on one of the channels, channel 2, to the alarm centre for direct alarm and in part it is raised through another intermittent signal that is sent continuously on another channel, channel 1, being turned off at the same time. Lack of this intermittent signal to the alarm centre activates another alarm for water contact. The second alarm is activated with a certain time delay depending on the adjusted periodicity or sending interval of the intermittent signal from the alarm unit and depending on the adjusted parameters or limits for when the alarm shall be activated in the alarm centre with regard to the intermittent nature or the periodicity of the signal's reception there.

A third drowning accident alarm is achieved in that the signal on the second channel, channel 2, does not reach the alarm centre when the alarm unit is at a sufficient depth of water. An alarm signal for water on channel two, that initially receives and activates the water alarm in the alarm centre, will continuously grow weaker at the rate with which the alarm unit and the individual to which it is attached sinks deeper in the water since the increased water mass steadily dampens the signal strength. At a certain water depth the signal will no longer reach the receiver in the alarm centre, which produces a signal that the alarm unit and thus the individual is at a great depth of water.

In this way the system and method according to the present invention makes a safer water alarm possible since an alarm is always activated even if the first direct signal does not reach the alarm centre. For instance a concrete quay, boat or some other object can keep the direct signal from reaching the alarm centre for a water alarm. The alarm for contact with water will still be activated through lack of the second signal to the centre, although with a certain time delay that depends on the adjusted limits for the allowed intermittent nature or the periodicity of the signal to the alarm centre. Since there is always a great hurry when it comes to a possible drowning accident it is clearly preferred that the first direct signal be received for a faster water alarm, but the double alarm on separate channels ensures at least that the alarm is always activated for the risk of drowning, which there often is when for instance truly small children that are not monitored get in water.

According to the present invention, the intermittent signal from the alarm unit functions simultaneously as a zone alarm on exceeding the distance or alternately not reaching the distance where an allowed signal state for the strength and the periodicity at reception of the signal is adjustable in the alarm centre and comprises limits outside which a zone alarm is activated. Outside the allowable signal state, or the so-called "normal state", that is freely adjustable by a supervisor with regard to the strength and the time interval for the intermittent signal on its reception in the centre, the zone alarm is thus activated. This means for instance that an intermittent signal received with either too weak or too strong signal strength or with the wrong time interval, compared with the adjusted limits for the "normal state", will activate the alarm and that an alarm can thereby be realised both at a too large a distance from the alarm centre as well as at a too small a distance from the same.

The advantage of an intermittent continuous signal being used for the second alarm on contact with water and for the zone alarm instead of an uninterrupted continuous signal is among other things the uninterrupted signal's sensitivity to interference. The risk of a "false alarm" being activated too often would be great for such a signal in a solution for monitoring as described with the present invention. Intermittent signals broadcast with between 5 and 15 seconds' periodicity, for instance, make it possible for a child or other monitored being to be hidden by an object that otherwise would block or dampen the uninterrupted signal to the centre, for instance, without an alarm's therefore being activated. Furthermore, the intermittent signal has the advantage of saving power, which in the embodiment with a battery as the power source for the alarm unit means that it can be used for a considerably longer time period before the battery must be changed or alternatively charged again.

In an alternative embodiment a continuous uninterrupted signal can actually also be used on channel 1 instead of an intermittent signal in order to activate another water alarm and for a zone alarm. In order not to risk false alarm then at a certain time interval a signal receiver in the alarm centre is adjusted instead to check that the continuous signal exists on channel 1. If a signal is discovered to be lacking in such a control an alarm is activated. In this solution the signal receiver in the alarm centre functions intermittently instead of the signal sender in the alarm unit.

Usually zone monitoring is used in order to pre-warn or prevent for instance a monitored child from sneaking away toward any hazard. Because the signal grows weaker at the rate with which the child and thereby the alarm unit gets further from the alarm centre an alarm is activated when the received signal, at a too large distance, finally gets outside the "normal state" with regard to its signal strength to the alarm centre. Alternatively the intermittent signal to the alarm centre is blocked or grows weaker due to an object or a building during a time period that is longer than that allowed according to the adjusted limits for the signal's periodicity and an alarm is then activated since the signal is also outside the adjusted parameters for the "normal state". For instance a child can be within the allowed distance from the alarm centre, but an automobile or other vehicle or space blocks or weakens the signal so that the alarm is activated. This means that children in for instance playgrounds and similar locations can be better monitored and protected against kidnapping and abduction.

For instance the alarm centre can also be placed at or near whatever comprises any danger in itself, such as an open fireplace, a pool or other place with water, a gate opening, a flight of stairs or the like, in order to give alarms when a child, domestic animal or other monitored being comes too near such a location because the signal then becomes too strong in relation to the adjusted limits for its reception in the alarm centre.

In FIG. 1 an alarm unit 10 according to an embodiment of the present invention is illustrated with flow chart. The alarm unit 10 is intended to be attached to a being, such as a human being or an animal, that is to be monitored and it is powered by a source of energy such as a battery, a solar cell or it is powered with a spring device that can be self winding by for instance movement.

In the alarm unit 10 a sender is arranged for continuous wireless transfer of intermittent signals on a first channel called channel 1, and transfer of an arbitrary type of signal on another channel called channel 2, which signal is activated by an included water sensor on contact with a water surface.

In an embodiment of the present invention the water sensor includes a first and a second disk made of electrically conducting material. The disks are arranged near each other with the first disk connected to a power source in the alarm unit 10 and wherein the second disk becomes conducting via the first disk and the water gap formed between the disks at water contact in order to activate the signal on the second channel. Alternately the water sensor consists of a pressure sensor that, at a pre-adjustable water pressure, activates the signal or of an optical sensor that on water detection activates the signal on the second channel.

A predetermined quantity of water at which the water alarm is activated can for instance be adjusted in a water sensor with a pressure sensor in order to detect anything from contact with a water surface to a given water depth at which the alarm is activated by adjusting different pressure values for giving alarms. Alternately a predetermined quantity of water at which a water alarm Is activated consists of the quantity of water that is needed in order to sufficiently fill the air gap between the two disks of electrically conducting material so that current can be lead from the voltage carrying first disk through the water gap to the second disk.

Figure 2A:
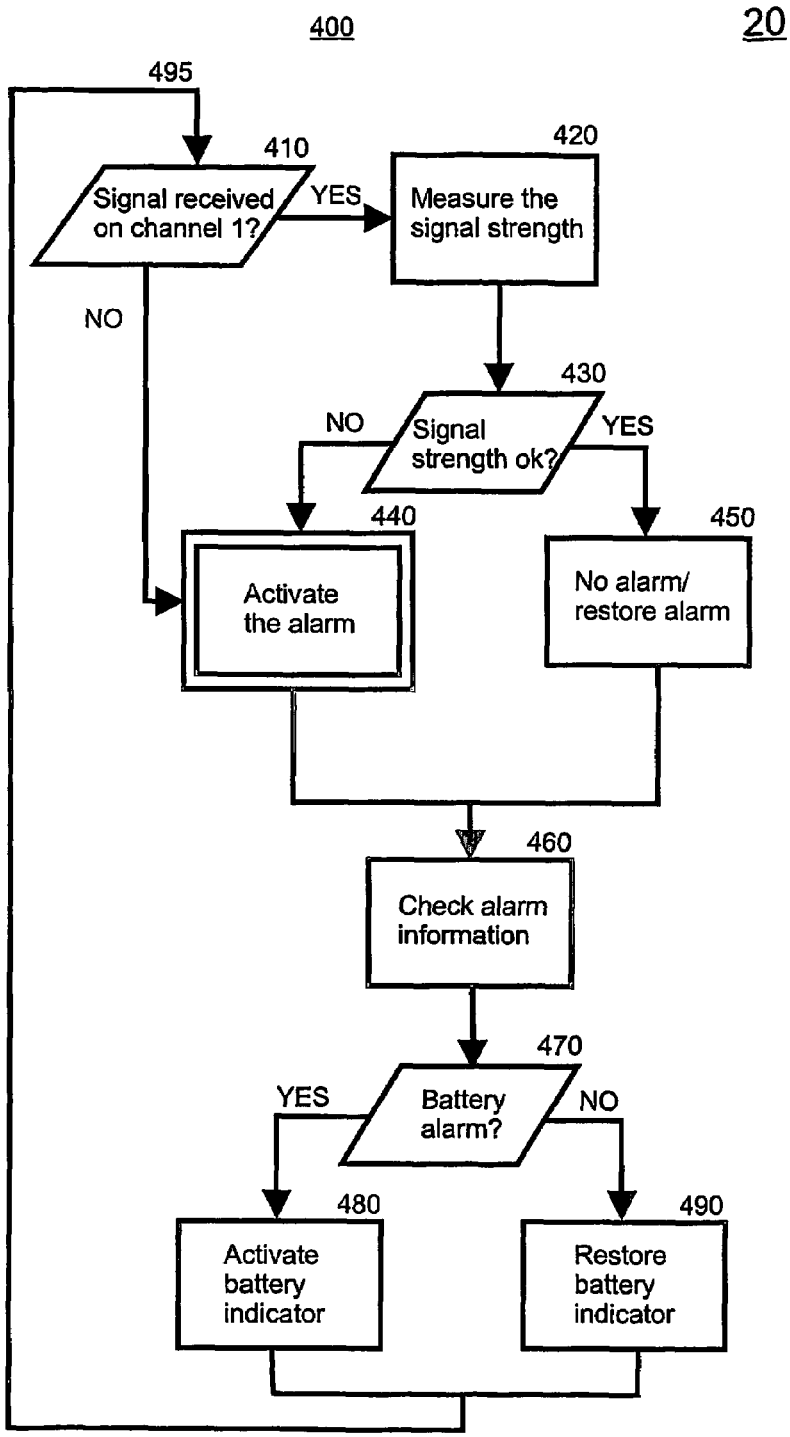
FIGS. 2*a* and 2*b*, an alarm centre 20 for receiving signals on two channels (channel 1 and channel 2) is illustrated with flow charts 400 and 500, and which is handled by a person that monitors the being to which the alarm unit 10 is attached, according to an embodiment of the present invention.
Figure 2B:
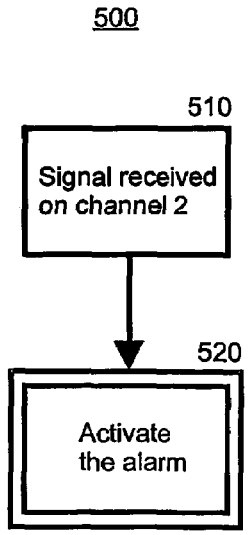

An alarm centre 20 shown with flow charts 400 and 500 in FIGS. 2*a* and 2*b*, respectively, receives signals sent from both channels for status monitoring of the alarm unit 10.

The alarm unit 10 also includes a switch that, on a signal for contact with water from the water sensor, breaks off signalling the intermittent signal on the first channel when the arbitrary type of signal is sent to the alarm centre on channel 2.

In an embodiment of the invention the alarm unit includes an adjustment means for free adjustment of the time interval for the intermittent signals' transmission from the unit. Such means can for instance consist of a hand knob or similar manoeuvre device with different positions for selectable time intervals. Alternatively the intermittent nature, the time interval or the periodicity of the signal's transmission can be adjusted and transferred electronically from the alarm centre to the alarm unit via included technology for wireless data transmission.

The alarm unit also includes a lockable attachment device for dependable fastening to the beings to be monitored. According to an embodiment of the invention, the lock to the attachment device is manipulation proof because the intermittent signal is turned off on manipulation of the lock mechanism so that the alarm is activated on channel 1. For instance this is realised by a powered circuit connected to the signal sender being broken when the lock is opened whereby the signal is stopped. Alternatively the attachment device itself is manipulation proofed in the same way. In case the alarm unit is turned off unwittingly or knowingly the alarm is also activated because of the missing signal on channel 1. In an embodiment of the invention the unit is arranged on a bracelet with a locking device and can be attached around a wrist, ankle, around the throat/neck or the like on a being that is to be monitored.

In the flow chart for the alarm unit 10 whether the alarm state is fulfilled 100 is checked and if the alarm state is not fulfilled the battery level 110 is checked according to adjusted parameters for the battery's degree of charging. If the battery level is not fulfilled 120 according to the parameters the battery status is set to low 130, otherwise the battery status is set to OK 140. Independent of whether the battery status is set to low 130 or OK 140 a signal is then sent that belongs to the series of intermittent signals on channel 1 along with the battery status to the alarm centre 20 and the entire procedure is repeated 160 thereafter.

In the case when an alarm state is confirmed 100, whether the alarm state is caused by contact with water 170 is checked and in such cases a direct signal 180 is sent to the alarm centre 20 on channel 2 after which the intermittent continuous signal on channel 1 is stopped and the alarm unit's alarm is activated. If there is an alarm state because of the lock being opened or because the bracelet has broken then the intermittent continuous signals on channel 1 are stopped and the alarm units alarm is activated.

In an embodiment of the invention the alarm unit's alarm is activated acoustically by a sound emitting means included in the unit 10, for instance a loudspeaker, buzzer or similar means for acoustic alarming.

In FIGS. 2*a* and 2*b* flow charts 400 and 500 and an alarm centre 20 for receiving signals on the two channels, channel 1 and channel 2, respectively, are illustrated according to an embodiment of the present invention. The alarm centre 20 is handled by a person that monitors the being to which an alarm unit 10 is attached. The centre 20 includes an alarm device that triggers, activates, the alarm if the intermittent signal differs from a predetermined intermittent signal state also called the "normal state". The signal state consists of the intermittent signal's strength and periodicity at its reception in the alarm centre.

A threshold value switch is arranged in the alarm centre 20 for free adjustment of the limits of the intermittent signal's strength and periodicity within which there is a "normal state" at its reception in the centre. With the threshold value switch limits can be freely adjusted by a supervisor who for instance wants to adjust the distances from or to the centre 20 within which a child with an alarm unit 10 attached to him/her is able to move without activating the zone alarm.

For instance a parent with children who himself/herself is around 20 meters from the ocean on a beach can adjust an allowed signal state, the so-called "normal state", on the centre with a value of the minimum accepted signal strength on channel 1 that allows the child to move within a radius of about 15 meters away from the unit without the zone alarm being activated. Alternatively the alarm centre is placed at the grill and a value of the maximum allowed signal strength adjusted so that the child cannot come closer than for instance around 5 meters without the alarm being activated. An upper and a lower limit for the allowed signal strength can also be adjusted and be valid simultaneously via a threshold value switch in the alarm centre. For instance this can be used if there are double dangers for the child such as that the grill is on a beach property.

In the flow chart 400 of the alarm centre 20 in FIG. 2*a* whether a signal is received 410 on channel 1 from the alarm unit 10 is checked according to parameters or limits for the "normal state" adjusted with regard on the periodicity. If a signal is not received on channel 1 according to these limits the alarm 440 is activated. If the signal is received within the periodicity limit values the signal strength 420 is measured and compared with the adjusted limits 430 for the allowed signal strength. If the signal strength at check is outside the limits of the "normal state" with regard to the allowed signal strength the alarm 440 is also activated. Otherwise, if the signal strength is inside the limits, no alarm is given or alternately an earlier activated alarm is restored. For instance, this happens if a monitored child was temporarily located far from the alarm centre and once again is back within the "allowed" distance. Alarm information is checked 460 thereafter, both in the case when the alarm was activated 440 and when it was not activated or was restored, and whether it is a battery alarm 470 is queried. In case it is a battery alarm the battery indicator is activated in the centre 20. Otherwise the battery indicator 490 is restored. Thereafter the procedure is repeated 495. In the flow chart 500 for the alarm centre 20 in FIG. 2*b* whether a signal is received 510 on channel 2 is checked from the alarm unit 10. If a signal is received 520 on channel 2 the alarm is activated.

Figure 3:
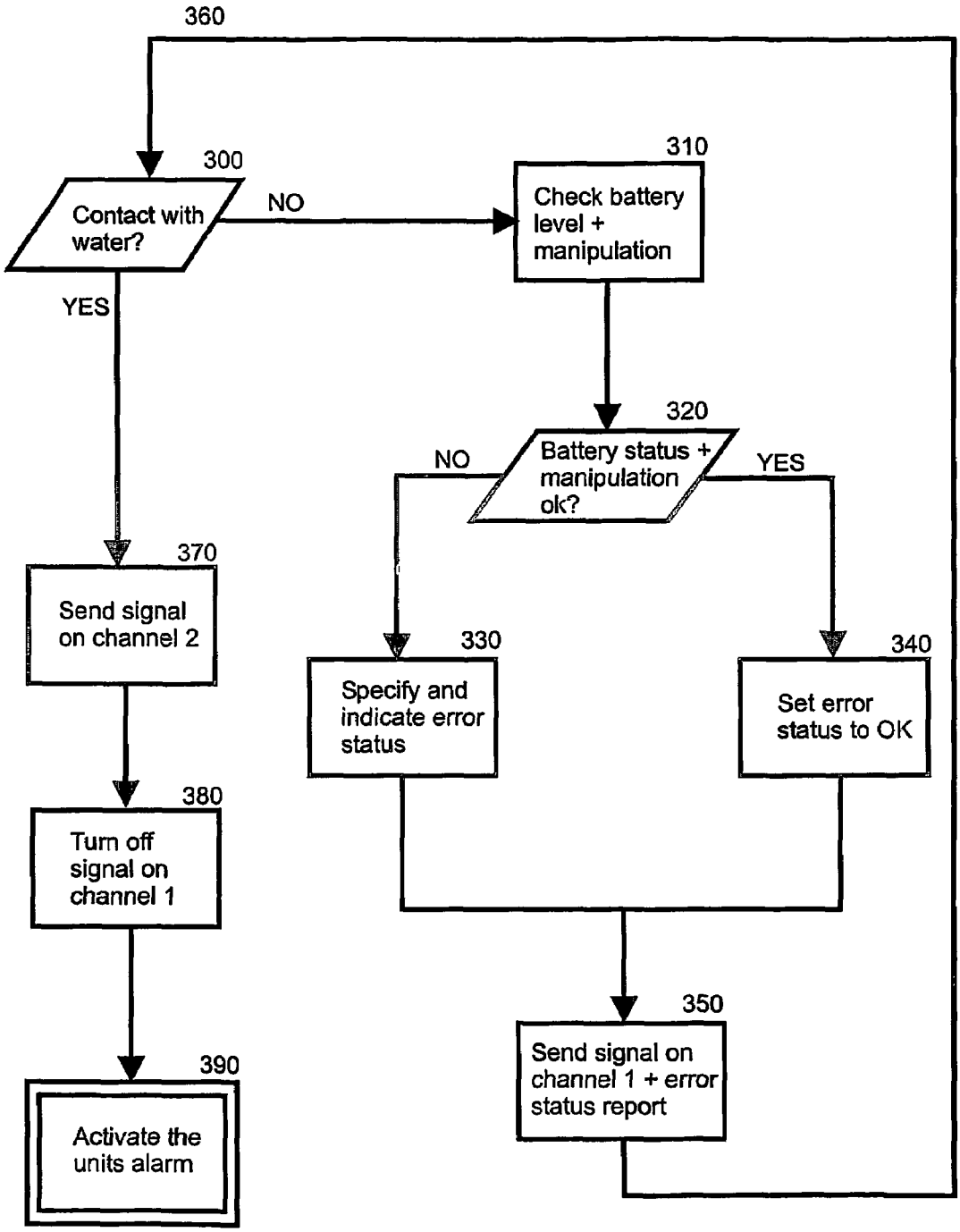
FIG. 3, a flow chart illustrates an alternative embodiment of an alarm unit 30 intended to be attached to a being to be monitored.
Figures 4A, 4B:
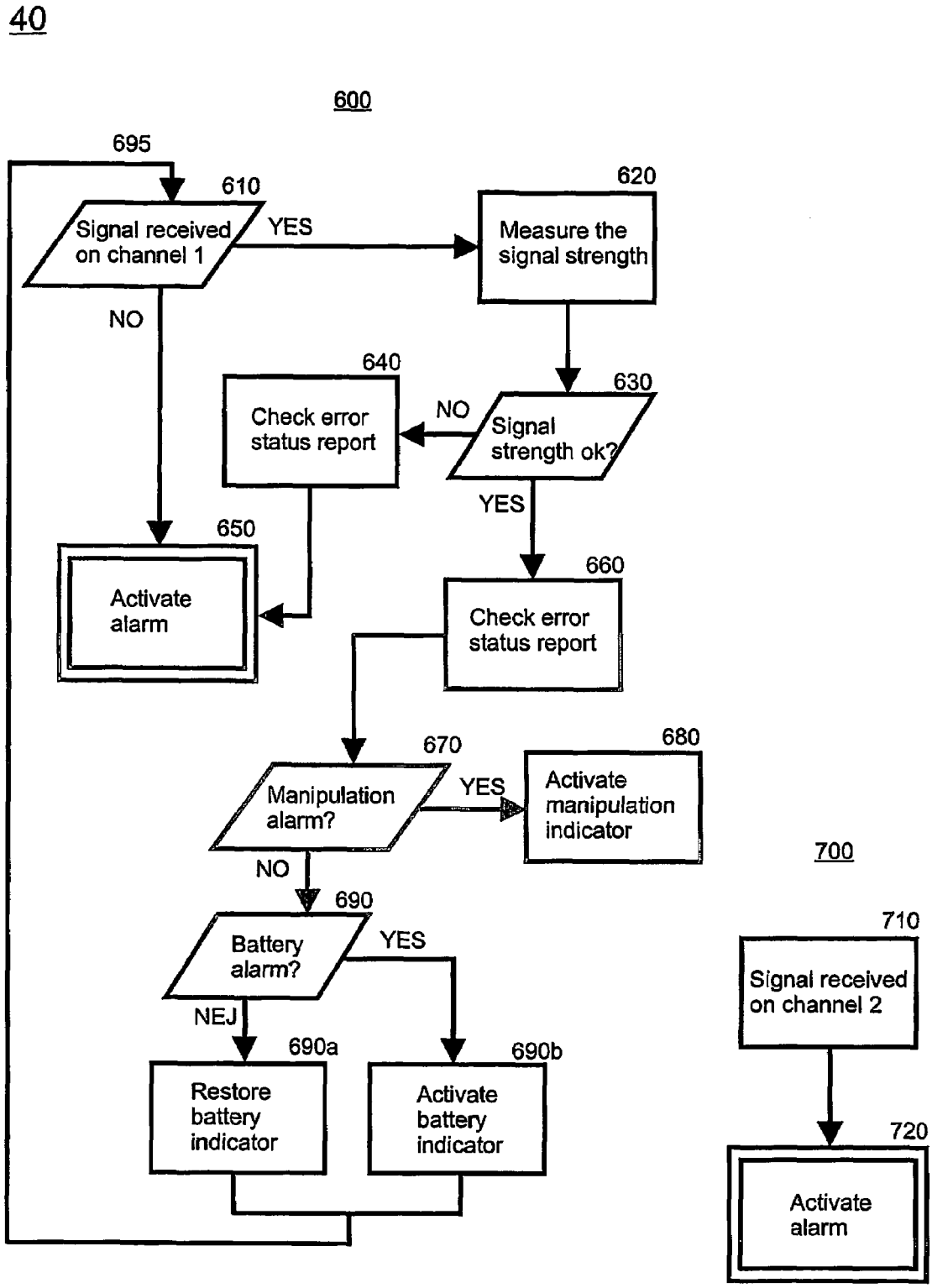
FIGS. 4*a* and 4*b*, an alternative embodiment of an alarm centre 40 for receiving signals on two channels (channel 1 and channel 2) is illustrated by flow charts 600 and 700, and which is handled by a person that monitors the being to which the alarm unit 30 is attached.

In FIG. 3 an alternative embodiment of an alarm unit 30 is illustrated intended to be attached to a being to be monitored where instead manipulation of the attachment device is checked along with a battery status check and where an error status report is composed and signalled to the alarm centre 40 displayed in FIGS. 4*a* and 4*b* without having to activate a units alarm 390 on manipulation of the attachment device.

In FIGS. 4*a* and 4*b* an alternative embodiment of an alarm centre 40 for receiving signals on two channels (channel 1 and channel 2) from an alarm unit 30 is illustrated. The error status report, i.e, signal, is checked and a manipulation indicator 680 and/or a battery indicator is activated in the centre 40 on a signalled manipulation of the attachment device or on a signalled battery level that is lower than the adjusted parameters for the battery's degree of charging.

An embodiment of the invention includes that in each signal to the alarm centre there is an ID string or a connection to an ID string that identifies which unit broadcasts the signal. The unit's unique ID string can be coupled to a person's name in the alarm centre for an individually chosen acoustic or visual alarm, for instance activated on a display on the centre.

In yet another embodiment of the invention a position determination of the being with the alarm unit is achieved through a positioning device included in the alarm unit or the alarm centre, such as a GPS receiver or similar positioning device, by continually transferring the thus received position coordinates of the alarm unit to the alarm centre or by transferring them to the centre according to an adjustable time interval or on an activated alarm.

GPS (Global Positioning System) is a system with 24 satellites for identification of ground positions. Through triangulation of the signals from three of the satellites a receiver unit can point out its current position anywhere on the earth to within a few meters.

According to a further embodiment of the invention, the sender in the alarm unit consists of a radio sender. Alternatively other known types of signal senders can be used in order to send signals.

According to another embodiment of the invention, the signals are received in the alarm centre via an included radio signal receiver. Alternatively other known types of signal receivers can be used in order to receive signals.

In an embodiment, the alarm unit includes an adjustment device for adjusting the configuration of both the intermittent and the arbitrary signal's radio frequencies and the alarm centre can be arranged to receive signals with separate radio frequencies.

In an additional embodiment of the invention the alarm device in the alarm centre is arranged to activate distinguishable visual and/or acoustic alarms depending on the signal's radio frequency so that several alarm units can be coupled to one and the same alarm centre for signal frequency adjusted specific zone and water alarming for each connected alarm unit.

In another embodiment of the invention the alarm unit is arranged with a battery level sensor in order to signal the battery status and the alarm centre includes a battery alarm, for instance in the form of a lamp, acoustic battery alarm or with a battery indicator on a display that can be activated on signalling the battery status from the alarm unit.

In yet another embodiment of the invention the second channel or channel 2 consists of the time gaps between the intermittent signals on the first channel, channel 1.

In yet another embodiment of the invention the channels can consist each of its own frequency on a radio carrier wave or similar known techniques for radio transfer can be used.

The above mentioned means to achieve the aim of the present invention can consist of hardware, software or a combination of both, which in themselves are known by a man skilled in the art.

The present invention has been described in the form of preferred embodiments, but it is not therefore limited to these, but rather it is the attached claims that define the invention for the skilled man.

The invention claimed is:

1. System for monitoring live beings, which combines zone and water alarming, including an alarm unit to be arranged on a being's body and a portable alarm centre handled by a person that monitors the being, wherein the alarm unit includes a sender for continuous wireless transfer of intermittent signals on a first channel and transfer of an arbitrary type of signal on another channel, and wherein the alarm centre receives signals sent from both channels for status monitoring of the alarm unit, wherein an alarm device in the alarm centre triggers alarms if the intermittent signal differs from a predetermined intermittent signal state; a water sensor in the alarm unit triggers the alarm unit to send the arbitrary type of signal on the second channel on contact with a predetermined quantity of water; switches in the alarm unit turning off signalling on the first channel when the arbitrary type of signal is sent to the alarm centre; and wherein a normal state for monitoring within a distance zone from the alarm centre is when the intermittent signal is in said predetermined signal state, and wherein the risk of a drowning accident exists when the arbitrary type of signal is emitted on the second channel, wherein a drowning accident alarm is activated in the alarm centre, and wherein the switch turns off the intermittent signal, which means that the system has raised the alarm twice for a drowning accident through the prevailing signal state on both channels, and a third drowning accident alarm is achieved in that the signal on the second channel does not reach the alarm centre when the alarm unit is located at a sufficiently great depth of water.

2. System according to claim 1, wherein the signal state is determined by the intermittent signal's strength and periodicity at reception in the alarm centre.

3. System according to claim 2, wherein the alarm device in the alarm centre is arranged to activate an alarm in case at least one of the strength and the periodicity of the intermittent signal differs outside pre-adjusted limits.

4. System according to claim 3, wherein the alarm is arranged to be activated in case the signal differs outside the pre-adjusted limits a prescribed number of times one after the other by a prescribed margin of exceeding at least one of the time or the periodicity.

5. System according to claim 1, wherein the arbitrary signal is a continuous or intermittent signal.

6. System according to claim 1, wherein the second channel consists of time gaps between the intermittent signals on the first channel.

7. System according to claim 1, wherein each channel has its own frequency on a radio carrier wave.

8. System according to claim 1, wherein a threshold value switch is arranged in the alarm centre for adjustment of limits to the intermittent signal's strength and periodicity within which a normal state exists.

9. System according to claim 8, wherein the threshold value switch is arranged to be adjustable for the zone alarm for a strength of the received intermittent signal that does not reach an adjusted limit.

10. System according to claim 8, wherein the threshold value switch is arranged to be adjustable for the zone alarm for a strength of the received intermittent signal that exceeds an adjusted limit.

11. System according to claim 8, wherein the threshold value switch is arranged to be adjustable for the zone alarm for a strength of the received intermittent signal that does not reach an adjusted first limit and exceeds an adjusted second limit.

12. System according to claim 1, wherein the periodicity of transmission of the intermittent signals is adjustable with an adjustment device coupled to the sender in the alarm unit.

13. System according to claim 1, wherein an acoustic alarm is activated in the alarm unit when the water sensor triggers the signal on the second channel to the alarm centre.

14. System according to claim 1, wherein the water sensor includes a first and a second disk made of electrically conducting material and wherein the disks are arranged near each other, wherein the first disk is connected to a power source in the alarm unit and wherein the second disk becomes conducting via the first disk and the water gap formed between the disks on water contact, in order to trigger the signal on the second channel.

15. System according to claim 1, wherein the water sensor includes a pressure sensor that, at a pre-adjustable water pressure, triggers the signal on the second channel.

16. System according to claim 1, wherein the water sensor includes an optical sensor or another indicator for water detection.

17. System according to claim 1, wherein the alarm unit includes an attachment device with a lock device to securely fix the unit on beings.

18. System according to claim 17, wherein the attachment device includes manipulation protection that activates the arbitrary signal on manipulation of the lock device.

19. System according to claim 17, wherein the attachment device includes manipulation protection that cancels the intermittent signal on manipulation of the lock device.

20. System according to claim 1, wherein the alarm centre includes a loudspeaker for acoustic alarming.

21. System according to claim 1, wherein the alarm centre includes a display for visual alarming.

22. System according to claim 1, wherein the alarm unit includes an adjustment device to adjust configuration of both the intermittent and the arbitrary signal's radio frequencies.

23. System according to claim 22, wherein the alarm device in the alarm centre is arranged to activate distinguishable visual and/or acoustic alarms depending on the signal's radio frequency so that several alarm units can be coupled to one and the same alarm centre for signal frequency adjusted specific zone and water alarms for each connected alarm unit.

24. System according to claim 1, wherein the alarm centre is arranged to receive signals with separate radio frequencies.

25. System according to claim 1, wherein each signal to the alarm centre includes a connection to an ID string that identifies which alarm unit broadcasts the signal.

26. System according to claim 25, wherein the unique ID string is connected to a person's name in the alarm centre for an individually chosen alarm that can be at least one of acoustically and visually activated on a display on the centre.

27. System according to claim 1, wherein a position determination of the alarm unit is achieved through a positioning device included in the alarm unit and the alarm centre, wherein the position coordinates of the alarm unit are transmitted to the alarm centre.

28. System according to claim 27 wherein the positioning device comprising a GPS receiver or similar positioning device.

29. Method of monitoring live beings, which combines zone and water alarm, including an alarm unit to be arranged on a being's body and a portable alarm centre handled by a person that monitors the being, wherein the alarm unit includes a sender for continuous wireless transfer of intermittent signals on a first channel and transfer of an arbitrary type of signal on a second channel, and wherein the alarm centre receives signals sent from both channels for status monitoring of the alarm unit, comprising:

activation of an alarm in the alarm centre when the intermittent signal differs from a predetermined intermittent signal state;

sending the arbitrary type of signal on the second channel when a water sensor, included in the alarm unit, detects contact with a predetermined quantity of water;

canceling signaling on the first channel by a switch in the alarm unit when the arbitrary type of signal is sent to the alarm centre; and wherein a normal state for monitoring within a distance zone from the alarm centre is when the intermittent signal is in said predetermined signal state, and wherein the risk of a drowning accident exists when the arbitrary type of signal is emitted on the second channel, wherein a drowning accident alarm is activated in the alarm centre, and wherein the switch turns off the intermittent signal, which means that the system has raised the alarm twice for a drowning accident through the prevailing signal state on both channels, and a third drowning accident alarm is achieved in that the signal on the second channel does not reach the alarm centre when the alarm unit is located at a sufficiently great depth of water.

30. Method according to claim 29, further comprising determining the signal state by the intermittent signal's strength and periodicity at reception in the alarm centre.

31. Method according to claim 29, wherein the arbitrary signal is a continuous or intermittent signal.

32. Method according to claim 29, wherein the second channel includes time gaps between the intermittent signals on the first channel.

33. Method according to claim 29, wherein each channel includes its own frequency on a radio carrier wave.

34. Method according to claim 29, wherein the threshold values within which a normal state exists for the intermittent signal's strength and periodicity is adjustable via a threshold value switch in the alarm centre.

35. Method according to claim 34, wherein the threshold value switch is adjustable for zone alarming at a strength of the received intermittent signal that does not reach a set limiting value.

36. Method according to claim 34, wherein the threshold value switch is adjustable for zone alarming at a strength of the received intermittent signal that exceeds a set limiting value.

37. Method according to claim 34, wherein the threshold value switch is adjustable for zone alarming for a strength of the received intermittent signal that does not reach an adjusted first limit and exceeds an adjusted second limit.

38. Method according to claim 29, wherein the periodicity of transmission of the intermittent signals is adjustable with an adjustment device coupled to the sender in the alarm unit.

39. Method according to claim 29, further comprising activating an alarm when at least one of the strength and the periodicity of the intermittent signal differs outside pre-adjusted limits.

40. Method according to claim 39, wherein the alarm is activated when the signal differs outside the pre-adjusted limits a prescribed number of times one after the other by a prescribed margin of exceeding at least one of the time and the periodicity.

41. Method according to claim 29, wherein an acoustic alarm is activated when the water sensor triggers the signal on the second channel to the alarm centre

42. Method according to claim 29, further comprising conducting current from a first voltage carrying disk included in the water sensor to a second nearby disk via a water gap formed between the disks on contact with water in order to trigger the signal on the second channel.

43. Method according to claim 29, wherein the water sensor including a pressure sensor that, at a pre-adjustable water pressure, triggers the signal on the second channel.

44. Method according to claim 29, wherein the water sensor including an optical sensor or another indicator for water detection.

45. Method according to claim 29, wherein the alarm unit is dependably attachable to the being to be monitored.

46. Method according to claim 45, wherein the arbitrary signal is activated on manipulation of a lock mechanism.

47. Method according to claim 45, wherein the intermittent signal is turned off on manipulation of a lock mechanism.

48. Method according to claim 29, wherein the alarm is given acoustically in the alarm centre.

49. Method according to claim 29, wherein the alarm is given visually in the alarm centre on an included display.

50. Method according to claim 29, wherein both the intermittent and the arbitrary signal's radio frequencies are adjustable.

51. Method according to claim 50, further comprising activating distinguishable visual and/or acoustic alarms depending on the signal's radio frequency so that several alarm units can be coupled to one and the same alarm centre for signal frequency adjusted specific zone and water alarms for each connected alarm unit.

52. Method according to claim 29, wherein signals with different radio frequencies are receivable in the alarm centre.

53. Method according to claim 29, wherein each signal to the alarm centre includes a connection to an ID string that identifies which alarm unit broadcasts the signal.

54. Method according to claim 53, wherein the unique ID string is connected to a person's name in the alarm centre for an individually adjusted alarm that can be at least one of acoustically and visually activated on a display on the centre.

55. Method according to claim 29, further comprising achieving position determination of the alarm unit being achieved through a positioning device included in the alarm unit and the alarm centre, wherein the position coordinates of the alarm unit are transmitted to the alarm centre.

* * * * *